US010679491B1

(12) United States Patent
Nalukurthy et al.

(10) Patent No.: US 10,679,491 B1
(45) Date of Patent: Jun. 9, 2020

(54) FIRE CONTROL PANEL CONFIGURATION

(71) Applicant: Honeywell International Inc., Morris Plains, NJ (US)

(72) Inventors: Rajesh Nalukurthy, Bangalore (IN); Jayaprakash Meruva, Bangalore (IN); Srivatsa Haridas, Bangalore (IN); Rich Lau, New York City, NY (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 16/359,614

(22) Filed: Mar. 20, 2019

(51) Int. Cl.
*G08B 17/00* (2006.01)
*G08B 25/14* (2006.01)
*G08B 29/22* (2006.01)

(52) U.S. Cl.
CPC ..... *G08B 25/14* (2013.01); *G08B 17/00* (2013.01); *G08B 29/22* (2013.01)

(58) Field of Classification Search
USPC ..... 340/525
See application file for complete search history.

(56) References Cited

U.S. PATENT DOCUMENTS 9,761,119 B1 9/2017 Trundle
9,851,924 B2 12/2017 Hwang et al.
10,074,254 B2 9/2018 Piccolo, III
2007/0130184 A1* 6/2007 Hogg ..... G06F 9/44505
2008/0072314 A1* 3/2008 Frenette ..... G08B 25/14 726/19
2013/0285799 A1* 10/2013 Probin ..... G05B 15/02 340/12.22
2015/0142898 A1* 5/2015 Piccolo, III ..... H05B 37/02 709/206
2017/0052536 A1 2/2017 Warner et al.

FOREIGN PATENT DOCUMENTS

CN 106537429 A 3/2017

* cited by examiner

*Primary Examiner* — Brent Swarthout

(74) *Attorney, Agent, or Firm* — Brooks, Cameron & Huebsch, PLLC

(57) ABSTRACT

Methods, devices, and systems for fire control panel configuration are described herein. In some examples, one or more embodiments include a memory, and a processor to execute executable instructions stored in the memory to receive configuration information for a fire control system of a facility, create a spatial asset model of the fire control system using the configuration information for the fire control system, and transmit, in response to detecting a replacement of a fire control panel in the fire control system with a new fire control panel, the spatial asset model to the new fire control panel.

17 Claims, 4 Drawing Sheets

FIRE CONTROL PANEL CONFIGURATION

TECHNICAL FIELD

The present disclosure relates to methods, devices, and systems for fire control panel configuration.

BACKGROUND

Facilities, such as commercial facilities, office buildings, hospitals, and the like, may have fire control systems that can be used during an emergency situation (e.g., a fire) to manage a fire event in and/or around the facility. For example, a fire control system may include sensors such as smoke detectors, heat detectors, and flame detectors, among other types of sensors, as well as control equipment such as fire control panels.

Fire control panels can control components of a fire control system in a facility. For example, a fire control panel can monitor and/or control fire hardware devices in the facility. For example, in an emergency situation such as a fire, a fire control panel can receive signals from a fire hardware device such as a sensor, and/or control other fire hardware devices to perform fire control operations.

DETAILED DESCRIPTION

Figure 1:
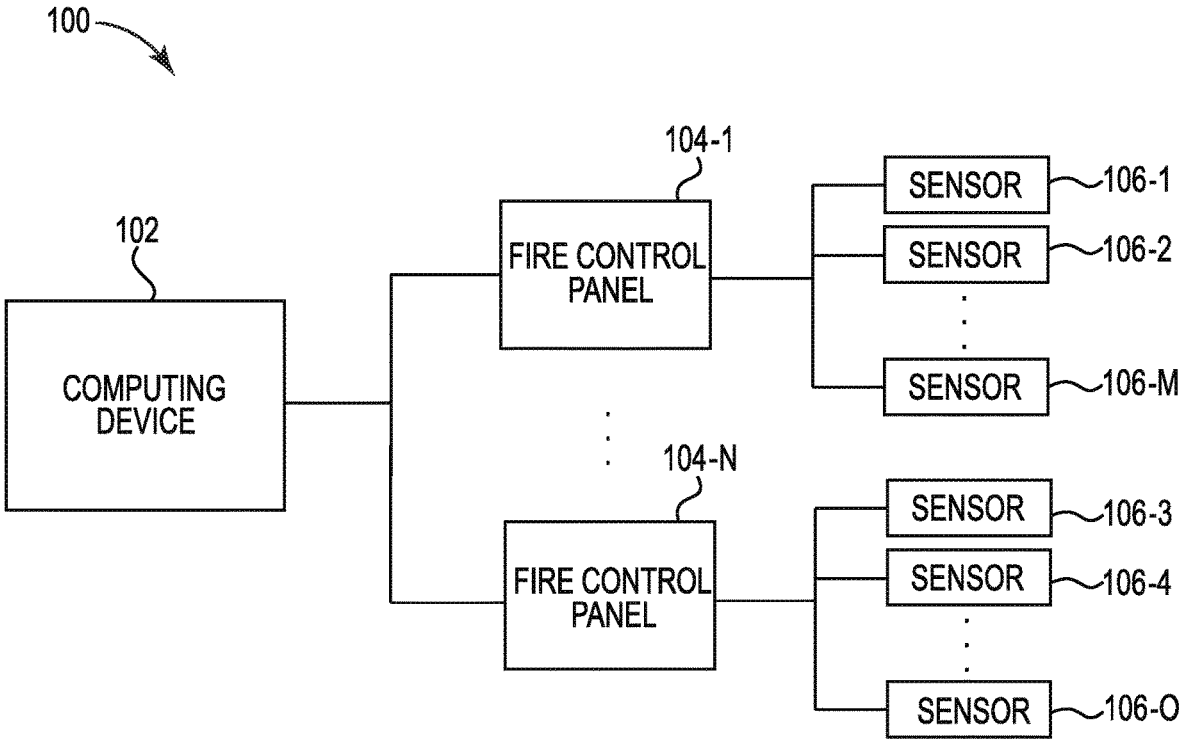
FIG. 1 is an example of a system for fire control panel configuration, in accordance with one or more embodiments of the present disclosure.

Methods, devices, and systems for fire control panel configuration are described herein. In some examples, one or more embodiments include a memory, and a processor to execute executable instructions stored in the memory to receive configuration information for a fire control system of a facility, create a spatial asset model of the fire control system using the configuration information for the fire control system, and transmit, in response to detecting a replacement of a fire control panel in the fire control system with a new fire control panel, the spatial asset model to the new fire control panel.

Fire control panels can be utilized in a facility to manage fire hardware devices in the facility. As used herein, the term "fire control panel" refers to a controlling component of a fire control system. For example, a fire control panel can receive information from fire hardware devices in the facility, monitor operational integrity of fire hardware devices in the facility, control fire hardware devices in the facility, and/or transmit information about fire hardware devices in the facility, among other operations. As an example, a fire control panel can receive information from, monitor, control, and/or transmit information about sensors in the facility. As used herein, the term "sensor" refers to devices designed to detect and report fires.

In some facilities, fire control panels may have to be replaced. For example, some facilities may include legacy fire hardware devices and, in order for a fire control system to function properly and/or safely, a new fire control panel has to be installed. In some examples, a new fire control panel may be installed for code purposes (e.g., to meet new and/or updated building code requirements).

Replacing an existing fire control panel, however, can present various challenges. For example, a technician may no longer have configuration data for the fire control panel being replaced. Even if a technician has the configuration data, it can be challenging to ensure the correct configuration file is matched with the correct fire control panel.

Another approach can be for a technician to travel to the site of the fire control panel being replaced, bringing a compatible software configuration tool for the fire control panel being replaced with the correct version of the software, pull the configuration data from the fire control panel to be replaced into a computing device, and setup a new fire control panel. However, a technician would have to possess knowledge and/or expertise for using the software, which may not always be the case.

Further, existing fire control panels may be connected to different fire control system subcomponents via various physical interfaces. For example, a fire control panel may be connected to a variety of other devices including digital alarm communicator transmitters (DACTs), liquid crystal displays (LCDs), panel circuits, and/or may be networked to other panels, etc. After replacing a fire control panel with a new fire control panel, a technician may have to bring the new fire control panel/fire control system to a normal operating state, which may be difficult because of the number of different connections the replaced fire control panel was connected to. Further, life time information such as system history, events captured over time, audit logs, etc. may be lost during replacement of an existing fire control panel with a new fire control panel.

Fire control panel configuration, in accordance with the present disclosure, can provide a way to easily configure a new fire control panel in a fire control system without extended commissioning time, effort, and/or cost. For example, a technician may not have to physically travel to the facility to synchronize a new fire control panel with the fire control system in the facility. Further, a digital view of the fire control panel, as well as the fire control system in the facility, can be generated via a model so that the fire control panel, its connectivity with other subsystems, and/or the health of each connection can be easily viewed. Accordingly, fire control panel configuration in accordance with the present disclosure can be useful for facility owners, operators, and/or technicians to easily replace/synchronize fire control panels in a facility, and/or monitor the health of the fire control system in a facility.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process, electrical, and/or structural changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 102 may reference element "02" in FIG. 1, and a similar element may be referenced as 202 in FIG. 2.

As used herein, "a", "an", or "a number of" something can refer to one or more such things, while "a plurality of" something can refer to more than one such things. For example, "a number of components" can refer to one or more components, while "a plurality of components" can refer to more than one component. Additionally, the designators "M", "N", and "0", as used herein particularly with respect to reference numerals in the drawings, indicates that a number of the particular feature so designated can be included with a number of embodiments of the present disclosure. This number may be the same or different between designations.

FIG. 1 is an example of a system 100 for fire control panel configuration, in accordance with one or more embodiments of the present disclosure. As illustrated in FIG. 1, the system 100 can include computing device 102, existing fire control panels 104-1, 104-N (referred to collectively as fire control panel 104), and sensors 106-1, 106-2, . . . 106-M, 106-3, 106-4, . . . 106-O (referred to collectively as sensors 106).

Computing device 102 can be, refer to, and/or include a laptop computer, desktop computer, server, or mobile device, such as, for instance, a smart phone or tablet, among other types of computing devices. However, embodiments of the present disclosure are not limited to a particular type of computing device. Computing device 102 may be located at a facility including system 100, such as, for instance, in a control room or operating room of the facility, or may be located remotely from the facility.

System 100 can be the fire control system of a facility (e.g., building), such as, for instance, a large facility having a large number of floors, such as a commercial facility, office building, hospital, and the like. However, embodiments of the present disclosure are not limited to a particular type of facility.

The fire control system can be used during an emergency situation (e.g., a fire) in the facility. For example, the fire control system may include a number of components, such as sensors 106 (among other components), located throughout the facility (e.g., in different rooms and/or on different floors of the facility) that can be used to perform fire control operations, including detecting and transmitting fire detection information about the facility.

Computing device 102 can receive configuration information for a fire control system of a facility. For example, fire control panels 104 can transmit, to computing device 102, configuration information about the fire control systems the fire control panels 104 are connected to. As used herein, the term "fire control panel" refers to a control panel installed in the facility that can be used by a user to directly control operation of the components of the fire control system in the facility. For example, fire control panels 104 can be connected to sensors 106 that can transmit a notification in response to a particular sensor of sensors 106 sensing a fire occurring in the facility. As a result, fire control panels 104 can control operations of components of the fire control system, such as generate alarms that can provide a notification of the fire to the occupants of the facility, fans and/or dampers that can perform smoke control operations (e.g., pressurizing, purging, exhausting, etc.) during the fire, and/or sprinklers that can provide water to extinguish the fire, among other operations. Fire control panels 104 can transmit configuration information to computing device 102 via a gateway device, as is further described in connection with FIG. 3.

As illustrated in FIG. 1, fire control panels 104-1 . . . 104-N can be located in a same facility and as part of a same fire control system in the facility. Although FIG. 1 is illustrated as having multiple fire control panels 104, embodiments of the present disclosure are not so limited. For example, the facility and the fire control system can include one fire control panel 104.

In some examples, fire control panels 104 can periodically transmit configuration information to computing device 102 at a predetermined interval. For example, fire control panels 104 can transmit configuration information to computing device 102 daily, every twelve hours, hourly, every half hour, every ten minutes, etc. The transmission frequency of the predetermined interval of the configuration information to computing device 102 can be modifiable/configurable. For instance, the transmission frequency can be modified from daily transmission of configuration information to every half hour, among other examples. Further, the transmission frequency can be different during different times of the day, different times of the week, different times of the month, different times of the year, etc. For instance, the transmission frequency can be every hour during normal business hours (e.g., Monday through Friday, 8 A.M. to 5 P.M.), and can be every two hours during the remaining portions of the day and on weekends, among other examples.

In some examples, configuration information for the fire control system can include fire hardware device configuration information. As used herein, the term "fire hardware device" refers to a component hardware device of a fire control system that can perform fire control operations. For example, a fire hardware device can include a fire sensor, fans, and/or dampers, among other types of fire hardware devices. As used herein, the term "configuration information" refers to a set and arrangement of internal and/or external components including hardware, software, and/or connected and/or peripheral devices.

Fire hardware device configuration information can include firmware for each fire hardware device included in the fire control system in the facility. As used herein, the term "firmware" refers to software included on a device that provides low-level control for the device's hardware, such as control, monitoring, and/or data manipulation functions, among other examples. For example, fire sensor configuration information can include firmware to control the fire sensor's monitoring of fires in the facility and the actions performed when a fire is sensed.

Fire hardware device configuration information can include state information for each fire hardware device included in the fire control system in the facility. As used herein, the term "state information" refers to quantifying information relating to a functional purpose of a fire hardware device. For example, state information of a sensor, such as a smoke detector, may include obscuration levels describing a sensitivity of the smoke detector. For example, sensor 106-1 can be an ionization smoke detector, and state information of sensor 106-1 can include an obscuration of 2.7% obscuration per meter (e.g., obs/m). However, embodiments of the present disclosure are not so limited to obscuration levels of sensors 106. For example, sensor 106-1 can be a heat sensor, and the state information of sensor 106-1 can be a temperature value, etc. Fire hardware device configuration information can include properties of each fire hardware device included in the fire control system in the facility. Such properties can include a brand, part number/device model, and/or commissioning information, among other properties. For example, sensor 106-1 can be manufactured by Company A, sensor 106-2 can be manufactured by Company B, etc. Accordingly, in such an example, the brand of sensor 106-1 can be Company A, the brand of sensor 106-2 can be Company B, etc. As used herein, the term "part number" refers to a number identifying a particular part, a particular type of part, a part classification, etc. For example, sensor 106-1 can be a smoke detector having part number 0001, sensor 106-2 can be a heat detector having part number 0785, etc. Commissioning information can include information such as alarm verification, walk-test participation, cause and effect outputs, among other commissioning information. Alarm verification can include commissioning, testing, and inspection of a fire alarm component (e.g., sensors 106) and wiring interconnections to confirm performance in order with the intended design. Walk-testing is a method of testing sensors 106 by having a technician walk around the facility to initiate a sensor 106. Cause and effect output testing is a method of testing sensors 106 by activating inputs of sensors 106 and determining which outputs occur as a result.

In some examples, configuration information for the fire control system can include fire control panel configuration information. For example, fire control panel configuration information can include information relating to an arrangement (e.g., setup) of internal and/or external components of the fire control panels 104, software of the fire control panels 104, devices connected to the fire control panels 104, peripheral devices of the fire control panels 104, etc.

Fire control panel configuration information can include panel variants of each respective fire control panel 104 included in the fire control system in the facility. For example, fire control panels 104-1 and 104-N can both be manufactured by Company A and both be a fire control panel from the same product line, but fire control panel 104-1 can be an earlier variant than fire control panel 104-N. In other words, fire control panel 104-1 can be an earlier model of fire control panel than fire control panel 104-N, and consequently may include outdated firmware, outdated physical interfaces, outdated features, etc. In some examples, fire control panels 104-1 and 104-N can both be manufactured by Company A but are from different fire control panel product lines. However, embodiments of the present disclosure are not limited to the above panel variants.

Fire control panel configuration information can include a configuration included in a configuration file of each fire hardware device included in the fire control system in the facility. As used herein, the term "configuration file" refers to a computer resource having instructions to cause a processor to perform actions relating to a particular fire control panel 104. For example, a configuration file can be a set of instructions dictating how a particular fire control panel 104, external components connected to the particular fire control panel 104, and/or peripheral devices connected to the particular fire control panel 104 are setup and operated. For example, a configuration file may include properties of a particular fire control panel 104, devices associated with the particular fire control panel 104, and connections (e.g., fire control panel loops) associated with the particular fire control panel 104, among other information. Fire control panel loops can refer to circuits operating as signaling lines. For example, fire hardware devices (e.g., such as sensors 106) can be devices associated with the fire control panels 104 in the facility and can be connected to fire control panel loops to communicate with fire control panels 104, among other examples.

Fire control panel configuration information can include each system each respective fire control panel 104 included in the fire control system in the facility is connected to. For example, fire control panels 104 can be connected to fire control panel loops, building management systems, fire control systems, etc. The fire control panel configuration information can include details regarding how fire control panels 104 are connected to other systems in the facility.

Fire control panel configuration information can include types of physical interfaces included in each respective fire control panel 104 included in the fire control system in the facility. As used herein, the term "physical interface" refers to a physical hardware interface between a fire control panel and another device. For example, each respective fire control panel 104 can include various types of physical interfaces, including universal serial bus (USB) interfaces, D-subminiature interfaces, Building Automation and Control (BAC) network (BACnet) interfaces, networking interfaces such as category 5 (Cat 5) interfaces, Firewire interfaces, serial AT attachment (SATA) interfaces including external SATA (eSATA) interfaces, among other types of serial and/or other physical interfaces.

In some examples, fire control panel configuration information can include saved operational data of the fire control panels 104. Saved operational data can include operational data of the fire control panels 104 saved over the lifetime of use of the fire control panels 104. For example, saved operational data may include events (e.g., fire events), times of events, dates of events, operational verification tests, maintenance data, audit logs, etc.

Saved operational data can be transmitted to computing device 102 in or near real time. For example, operational data as it is generated can be transmitted to computing device 102. In some examples, operational data can be viewed by a user (e.g., a building operator or other user) to make decisions about the fire control system.

As described above, computing device 102 can receive configuration information for a fire control system of a facility from fire control panels 104. Computing device 102 can create a spatial asset model of the fire control system in the facility using the configuration for the fire control system.

In some examples, the spatial asset model can include a configuration file. The configuration file included in the spatial asset model can include various configuration information of fire hardware devices and/or fire control panels 104 included in the fire control system. For example, the spatial asset model can include properties of each respective fire hardware device and/or fire control panel 104, connections of each respective fire hardware device and/or fire control panel 104, and/or instructions dictating how a respective fire control panel 104, external components connected to the fire control panel 104, and/or peripheral devices connected to the fire control panel 104 are setup and operated, among other types of configuration information.

In some examples, the spatial asset model can include firmware for each respective fire hardware device and/or fire control panel 104 in the fire control system. For example, the spatial asset model can include software for each respective fire hardware device and/or fire control panel 104 that provides control for each respective fire hardware device and/or fire control panel 104, such as control, monitoring, data manipulation functions, analysis and/or simulation of data to identify problems to prevent maintenance downtime, and/or optimizing overall operations to increase uptime, among other examples.

In some examples, the spatial asset model can include state information for each respective fire hardware device and/or fire control panel 104 in the fire control system. For example, the spatial asset model can include information quantifying a functional purpose of each respective fire hardware device and/or fire control panel 104, and can be included for various levels of the fire control system. For instance, the spatial asset model can include state information for each respective fire hardware device and/or fire control panel 104 at the fire control system network level (e.g., for the health of the entire network), fire control panel 104 loop level, and/or fire control panel 104 level itself.

In some examples, the spatial asset model can include system topologies. For example, the spatial asset model can include a fire control system topology. As used herein, the term "topology" refers to an arrangement and interlinking of hardware devices in a network. For example, the spatial asset model can include the arrangement of fire control panels 104 and/or fire hardware devices of a fire control system. Further, the spatial asset model can include a networking system topology. For example, the spatial asset model can include connections between fire control panels 104 and/or fire hardware devices of the fire control system. The spatial asset model can include a digital replica of the fire control system in the facility, as is further described in connection with FIG. 2.

In some instances, an existing (e.g., previously installed) fire control panel 104 may be replaced in the facility. For instance, a new fire control panel may be installed so the fire control system can utilize new features of the new fire control panel, replace a malfunctioning respective fire control panel 104, for code purposes, among other reasons.

Computing device 102 can transmit, in response to detecting a replacement of fire control panel 104 in the fire control system with a new fire control panel, the spatial asset model to the new fire control panel. For example, a new fire control panel can be installed to replace a malfunctioning fire control panel 104 in the facility. Computing device 102 can detect the replacement of the previous fire control panel 104 with the new fire control panel and transmit the spatial asset model to the new fire control panel. Computing device 102 can detect the new fire control panel via a gateway device, as is further described in connection with FIG. 3.

The new fire control panel can synchronize with the fire control system in the facility using the spatial asset model. For example, as described above the spatial asset model can include a configuration file having configuration information of the fire hardware devices and/or fire control panels 104 included in the fire control system, firmware for each respective fire hardware device and/or fire control panel 104 included in the fire control system, state information for each respective fire hardware device and/or fire control panel 104 included in the fire control system, and/or fire control system and/or networking system topologies, among other types of information. The new fire control panel can receive the spatial asset model and utilize the spatial asset model to synchronize with the rest of the fire control system. For example, the new fire control panel can configure itself with the correct firmware, establish connections with fire hardware devices via the various physical interfaces of the new fire control panel, and/or configure state information of the new fire control panel 104-1, among other operations. That is, the new fire control panel can synchronize with the fire control system in the facility using the configuration file, firmware, and state information included in the spatial asset model.

Computing device 102 can determine whether the synchronization with the fire control system was successful. For example, computing device 102 can receive configuration information from the new fire control panel and determine, based on the configuration information, whether the new fire control panel has been synchronized with the fire control system successfully. For instance, computing device 102 can determine whether the new fire control panel has successfully applied the correct/most recent configuration file, firmware, state information, whether the new fire control panel is communicating with other fire hardware devices and/or other devices in the fire control system, etc. In response to the determination, computing device 102 can transmit a notification, as is further described herein.

In response to a determination that the synchronization was successful, computing device 102 can transmit a notification regarding the determination. The notification can indicate the new fire control panel has successfully synchronized with the fire control system.

In some examples, the notification can be transmitted by computing device 102 to a facility control center. A facility control center may be operated by facility technicians, engineers, and/or other users that manage operations in the facility. The notification can be displayed on a user interface of a computing device included in the facility control center and can indicate to a user of the computing device the new fire control panel has been successfully synchronized with the fire control system in the facility. Accordingly, a facility manager can know that the new fire control panel is operating properly and no further work may be needed.

In some examples, the notification can be transmitted by computing device 102 to a mobile device of a user. The user may be a facility technician, engineer, and/or other user. The notification can be displayed on a user interface of the mobile device and can indicate to a user of the mobile device the new fire control panel has been successfully synchronized with the fire control system in the facility.

In response to a determination the synchronization was not successful, computing device 102 can transmit a notification regarding the determination. The notification can indicate the new fire control panel 104-1 has not successfully synchronized with the fire control system, as is further described herein.

In response to a determination the synchronization was not successful, computing device 102 can determine a type of change that is to be made to successfully synchronize the new fire control panel 104. For example, during installation of new fire control panel 104-1, a technician may have inadvertently connected a USB connection in an incorrect USB physical interface included in the new fire control panel 104-1. Computing device 102 can determine that the particular USB connection is connected to the incorrect USB physical interface included in the new fire control panel 104-1 and determine to which USB physical interface the USB connection is supposed to be connected.

If the synchronization was unsuccessful, the notification can display the type of change that is to be made to successfully synchronize the new fire control panel. Continuing with the example above, the notification can indicate that a USB connection is improperly connected.

The notification can include guided steps to make the type of change to successfully synchronize the new fire control panel 104-1. For example, the notification including the guided steps can be transmitted by computing device 102 to a mobile device of a user. Continuing with the example above, the guided steps can be illustrated on the user interface to illustrate the incorrect USB physical interface the USB connection is currently connected to, the steps to unplug the USB connection, and illustrate the correct USB physical interface to which the USB connection should be connected.

Fire control panel configuration, according to the present disclosure, can allow for seamless and efficient installation of fire hardware devices and/or fire control panels in a facility. Configuration information for a fire control system of a facility can automatically be compiled and stored. The configuration information may be stored on a computing device, which may be local to the facility, can be stored remotely (e.g., a cloud) and accessed via a network. The spatial asset model can additionally allow users such as building operators to gain insight on the health of the fire control system by giving information on the status of fire hardware devices/fire control panels in the fire control system. Further, fire control panel configuration, according to the present disclosure, can ease burdens associated with replacing legacy fire control panels by automatically applying information included in the spatial asset model to the new fire control panel, as well as providing guided steps to correct any other installation errors.

Figure 2:
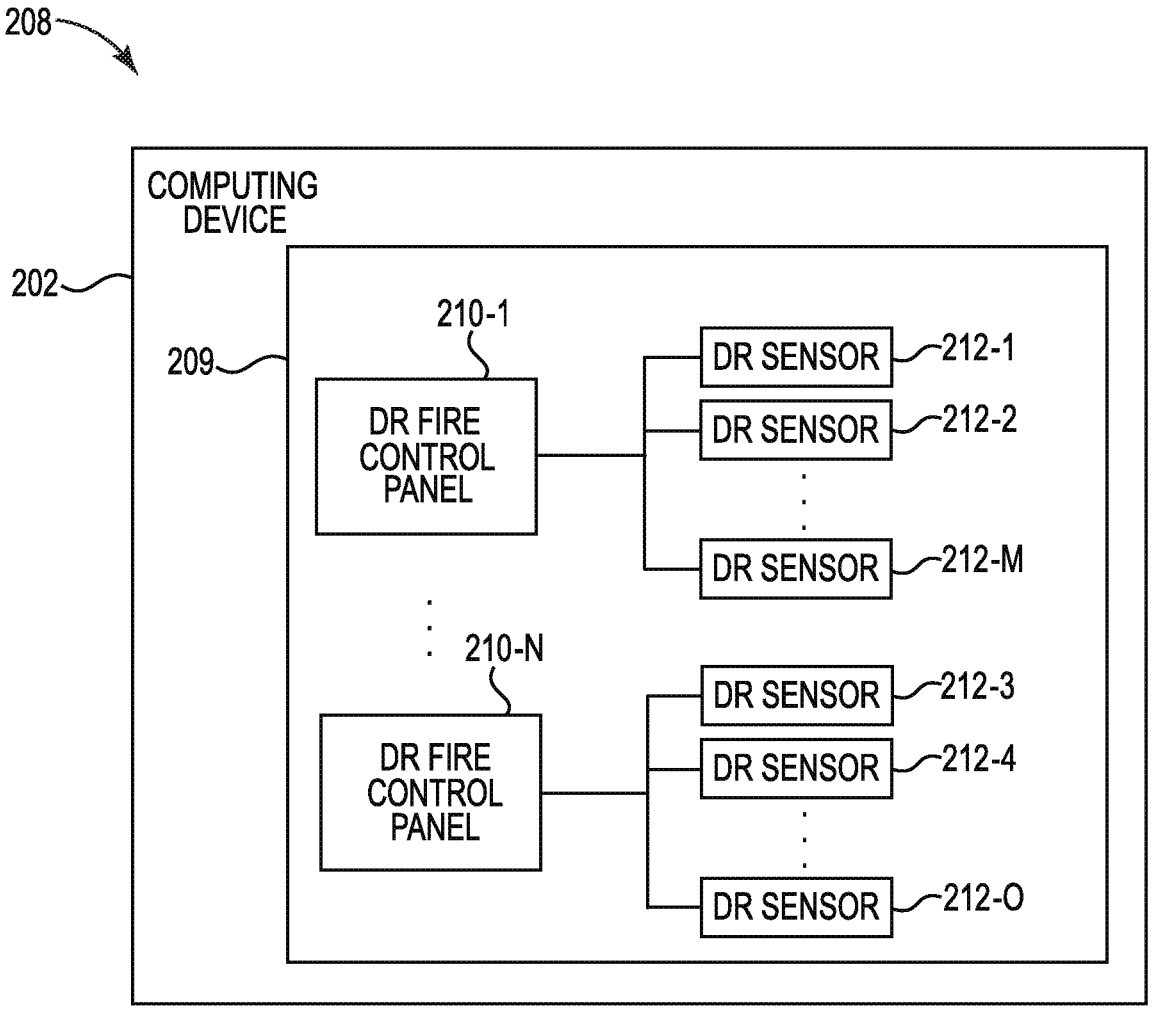
FIG. 2 is an example of a computing device including a digital replica of a system for fire control panel configuration, in accordance with one or more embodiments of the present disclosure.

FIG. 2 is an example of a computing device 202 including a digital replica of a system 208 for fire control panel control configuration, in accordance with one or more embodiments of the present disclosure. Computing device 202 can be, for example, computing device 103 previously described in connection with FIG. 1.

As illustrated in FIG. 2, computing device 202 can include a digital replica 209 of the fire control system in the facility. The digital replica 209 can include a digital replica (DR) of fire control panel 210-1, 210-2 (referred to collectively as digital replica of fire control panels 210), and a digital replica (DR) of sensors 212-1, 212-2, 212-M, 212-3, 212-4, 212-O (referred to collectively as digital replica of sensors 212). Further, although not illustrated in FIG. 2 for clarity and so as not to obscure embodiments of the present disclosure, the digital replica 209 can include digital replicas of other fire control system elements, such as a digital replica of a gateway device, digital replicas of fire control system peripherals, and/or a digital replica of the fire control system network, among other fire control system elements.

As previously described in connection with FIG. 1, the spatial asset model of the fire control system in the facility can include a digital replica 209 of the fire control system. The digital replica 209 can be a fire control system model including fire control system modeling data. The fire control system modeling data can include data associated with (e.g., quantities, properties, and/or statuses of) components, equipment, devices, networks, and/or other properties of the fire control system in the facility. For example, the fire control system modeling data can include mechanical, electrical, geometrical, and/or spatial (e.g., spatial relationship) information associated with components, equipment, and/or devices, associated with the fire control system in the facility.

For example, the digital replica 209 of the fire control system can include a digital version of each respective fire hardware device and/or fire control panel 210 of the fire control system in the facility. For instance, the digital replica 209 can include a digital version of each fire control panel 210-1, 210-2 and/or sensor 212-1, 212-2, 212-M, 212-3, 212-4, 212-O included in the facility. Further, although not illustrated in FIG. 2 for clarity and so as not to obscure embodiments of the present disclosure, the digital replica 209 can include digital versions of other hardware devices included in the fire control system in the facility. For instance, the digital replica 209 can include digital versions of networking components, physical interfaces, other sensors, etc. The digital replica 209 can also include a configuration file, firmware, and state information of each hardware device of a plurality of hardware devices of the fire control system in the facility.

The spatial asset model can include properties of the digital version of each respective digital replica of the fire hardware device and/or fire control panel 210 corresponding to the physical version of each respective fire hardware device and/or fire control panel, connections of each respective fire hardware device and/or fire control panel 210 corresponding to the physical version of each respective fire hardware device and/or fire control panel, instructions dictating how a fire control panel 210, external components connected to the fire control panel 210, and/or peripheral devices connected to the fire control panel 210 corresponding to the physical version of each respective fire hardware device and/or fire control panel are setup and operated, among other types of configuration information.

In some examples, the spatial asset model can include firmware for each respective digital replica fire hardware device and/or fire control panel 210 corresponding to the physical version of each respective fire hardware device and/or fire control panel in the fire control system. For example, the spatial asset model can include software for each respective fire hardware device and/or fire control panel 210 corresponding to the physical version of each respective fire hardware device and/or fire control panel that provides control for each corresponding fire hardware device and/or fire control panel, such as control, monitoring, and/or data manipulation functions, among other examples.

In some examples, the spatial asset model can include state information for each respective digital replica fire hardware device and/or fire control panel 210 corresponding to the physical version of each respective fire hardware device and/or fire control panel in the fire control system. For example, the spatial asset model can include information quantifying a functional purpose of each respective digital replica of fire hardware device and/or fire control panel 210 corresponding to the physical version of each respective fire hardware device and/or fire control panel in the fire control system.

The physical version of each respective fire hardware device and/or fire control panel in the fire control system can send, via a gateway device, telemetry data to computing device 202. The telemetry data can be used to update the digital replicas for each respective digital replica fire hardware device and/or fire control panel 210 corresponding to the physical version of each respective fire hardware device and/or fire control panel in the fire control system. For example, if there is a change in a number of fire hardware devices (e.g., a new fire hardware device such as a sensor is added to the fire control system), a new digital replica of the added fire hardware device can be added to the spatial asset model. As another example, if an address of a fire hardware device is changed, a corresponding address of the digital replica of the fire hardware device corresponding to the physical fire hardware device can be updated.

As previously described in connection with FIG. 1, an existing fire control panel may be replaced in the facility. Upon replacement of an existing fire control panel, the digital replica 209 of the fire control system can correspondingly be updated. For example, a physical fire control panel may be replaced in the facility, and accordingly, the digital replica fire control panel 210-1 may be correspondingly updated. For instance, the configuration file, firmware, and state information of the digital replica fire control panel 210-1 can be updated according to the corresponding new physical fire control panel in the facility.

Figure 3:
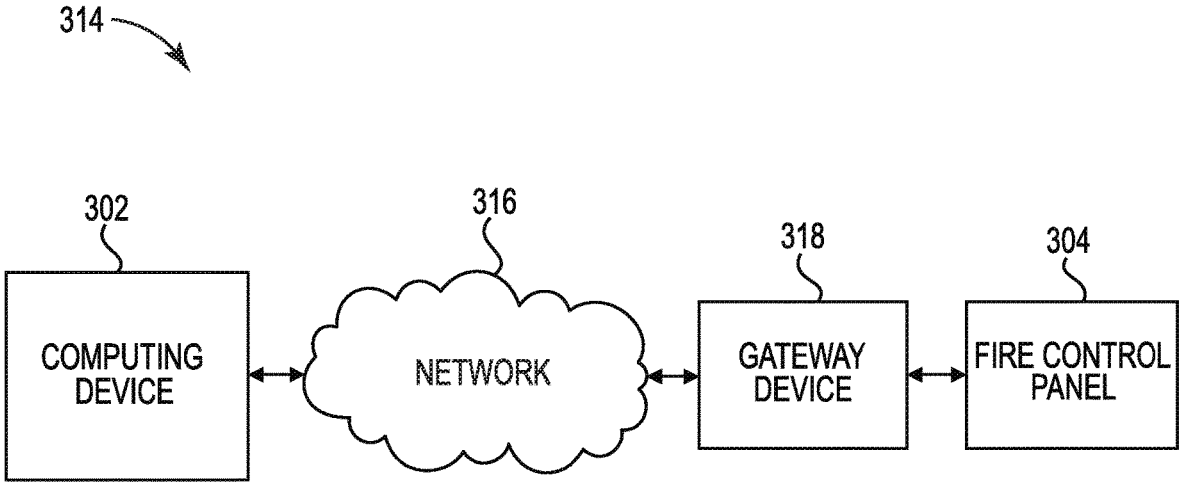
FIG. 3 is an example of a system for fire control panel configuration, in accordance with one or more embodiments of the present disclosure.

FIG. 3 is an example of a system 314 for fire control panel configuration, in accordance with one or more embodiments of the present disclosure. As illustrated in FIG. 3, system 314 can include computing device 302, fire control panel 304, network 316, and gateway 318.

Computing device 302 can receive configuration information from fire control panel 304 via network 316. Network 316 can be a wired or wireless network. The network 316 can be a network relationship through which computing device 302 can communicate with fire control panel 304 via gateway device 318. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, the network 316 can include a number of servers that receive information from, and transmit information to, computing device 302 and the fire control panel 304 via a wired or wireless network.

As used herein, a "network" can provide a communication system that directly or indirectly links two or more computers and/or peripheral devices and allows users to access resources on other computing devices and exchange messages with other users. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get a file or print on a network printer. Applications may also communicate with network management software, which can interact with network hardware to transmit information between devices on the network.

As previously described in connection with FIGS. 1 and 2, fire control panel 304 can transmit configuration information to computing device 302. Fire control panel 304 can transmit configuration information to computing device 302 via a gateway device 318 (and network 316).

A gateway device may be used by a user (e.g., maintenance technician or operator) to perform inspections, maintenance, and/or upgrades, among other operations, on a fire control system (e.g., on the components of the fire control system) of a facility. For instance, the user may connect the gateway device to the fire control panel 304 of the fire control system, and the gateway device can communicate with the fire control panel 304 to perform the tasks of the operation.

Gateway device 318 can facilitate processes described herein. For example, once gateway device 318 is connected to fire control panel 304, gateway device 318 can enable fire control panel 304 to transmit configuration information for a fire control system of a facility. Additionally, gateway device 318 can enable fire control panel 304 to receive a spatial asset model such that, in an example in which fire control panel 304 is a new fire control panel (e.g., an old fire control panel is replaced by new fire control panel 304), the new fire control panel 304 can synchronize with the fire control system in the facility using the spatial asset model.

Utilizing the gateway device 318 can allow for the creation of the spatial asset model in a facility, where the spatial asset model can include the digital replica of the fire control system in the facility. The digital replica of the fire control system in the facility can allow for users to view the status of the fire control system in the facility, including fire panels, fire hardware devices, etc. Further, the spatial asset model can allow for remote trouble shooting and guidance to avoid multiple site visits to facilities.

Figure 4:
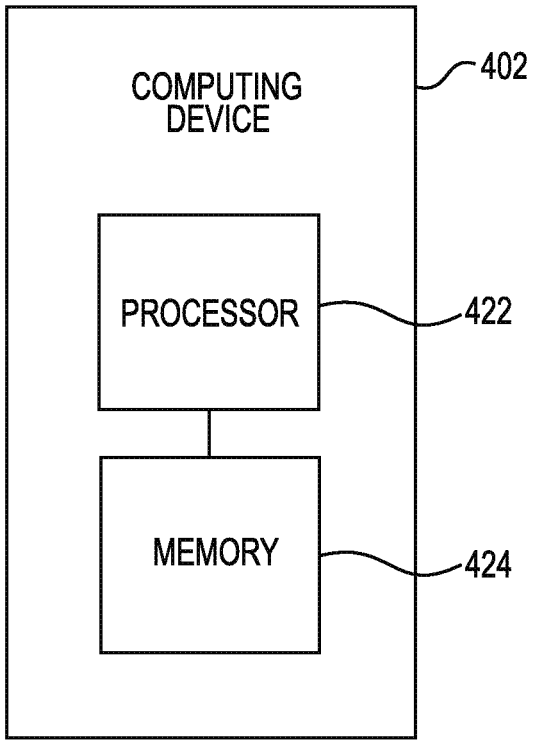
FIG. 4 is an example of a computing device for fire control panel configuration, in accordance with one or more embodiments of the present disclosure.

FIG. 4 is an example of a computing device 402 for fire control panel configuration, in accordance with one or more embodiments of the present disclosure. Computing device 402 can be, for instance, computing device 102 previously described in connection with FIG. 1.

As illustrated in FIG. 4, computing device 402 can include a memory 424 and a processor 422 for fire control panel configuration in accordance with the present disclosure.

The memory 424 can be any type of storage medium that can be accessed by the processor 422 to perform various examples of the present disclosure. For example, the memory 424 can be a non-transitory computer readable medium having computer readable instructions (e.g., computer program instructions) stored thereon that are executable by the processor 422 for fire control panel configuration in accordance with the present disclosure.

The memory 424 can be volatile or nonvolatile memory. The memory 424 can also be removable (e.g., portable) memory, or non-removable (e.g., internal) memory. For example, the memory 424 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical storage, and/or a magnetic medium such as magnetic cassettes, tapes, or disks, among other types of memory.

Further, although memory 424 is illustrated as being located within computing device 402, embodiments of the present disclosure are not so limited. For example, memory 424 can also be located internal to another computing resource (e.g., enabling computer readable instructions to be downloaded over the Internet or another wired or wireless connection).

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A computing device for fire control panel configuration, comprising:

a memory; and a processor configured to execute instructions stored in the memory to:

receive configuration information for a fire control system of a facility;

create a spatial asset model of the fire control system using the configuration information for the fire control system, wherein the spatial asset model includes:

a fire control system topology and a networking system topology of the facility; or a digital replica of the fire control system in the facility; and transmit, in response to detecting a replacement of a fire control panel in the fire control system with a new fire control panel, the spatial asset model to the new fire control panel.

2. The computing device of claim 1, wherein the processor is configured to execute the instructions to cause the new fire control panel to synchronize with the fire control system in the facility using a configuration file, firmware, and state information included in the spatial asset model.

3. The computing device of claim 1, wherein the digital replica of the fire control system includes a configuration file, firmware, and state information of each fire hardware device of a plurality of fire hardware devices of the fire control system in the facility.

4. The computing device of claim 1, wherein the digital replica of the fire control system includes a digital version of each fire hardware device of a plurality of fire hardware devices of the fire control system in the facility.

5. The computing device of claim 1, wherein the configuration information for the fire control system includes fire hardware device configuration information.

6. The computing device of claim 5, wherein the fire hardware device configuration information includes at least one of:

firmware for each fire hardware device included in the fire control system in the facility;

properties of each fire hardware device included in the fire control system in the facility; and state information of each fire hardware device included in the fire control system in the facility.

7. The computing device of claim 1, wherein the configuration information for the fire control system includes fire control panel configuration information.

8. The computing device of claim 7, wherein the fire control panel configuration information includes at least one of:

panel variants of each fire control panel included in the fire control system in the facility;

a configuration included in a configuration file of each fire hardware device included in the fire control system in the facility;

each system each fire control panel included in the fire control system in the facility is connected to; and types of physical interfaces included in each fire control panel included in the fire control system in the facility.

9. A non-transitory computer readable medium having computer readable instructions stored thereon that are executable by a processor to:

receive configuration information of a fire control system in a facility;

create a spatial asset model of the fire control system using the configuration information for the fire control system, wherein the spatial asset model includes a configuration file, firmware, and state information;

transmit, in response to detecting a replacement of a fire control panel in the fire control system with a new fire control panel, the spatial asset model to the new fire control panel; and cause the new fire control panel to synchronize with the fire control system in the facility using the spatial asset model; and determine whether the new fire control panel has been successfully synchronized.

10. The computer readable medium of claim 9, wherein in response to a determination the new fire control panel has been successfully synchronized, the computer readable instructions are executable by the processor to transmit a notification regarding the determination.

11. The computer readable medium of claim 9, wherein in response to a determination the new fire control panel has not been successfully synchronized, the computer readable instructions are executable by the processor to determine a type of change that is to be made to successfully synchronize the new fire control panel.

12. The computer readable medium of claim 11, including instructions to cause the processing resource to transmit a notification including the type of change, wherein the notification includes guided steps to make the type of change to successfully synchronize the new fire control panel.

13. A method for fire control panel configuration, comprising:

receiving, by a computing device, configuration information for a fire control system of a facility;

creating, by the computing device, a spatial asset model of the fire control system using the configuration information for the fire control system, wherein the spatial asset model includes a configuration file, firmware, and state information;

transmitting, by the computing device in response to detecting a replacement of a fire control panel in the fire control system with a new fire control panel, the spatial asset model to the new fire control panel;

synchronizing, by the new fire control panel, with the fire control system in the facility using the spatial asset model;

determining, by the computing device, whether the synchronization with the fire control system was successful; and transmitting, by the computing device, a notification based on the determination.

14. The method of claim 13, wherein the method includes transmitting, by the computing device, the notification to a user interface, wherein the notification is displayed on the user interface and includes an indication of whether the synchronization with the fire control system was successful.

15. The method of claim 14, wherein the method includes:

transmitting the notification to a mobile device having the user interface; and displaying the notification on the user interface of the mobile device.

16. The method of claim 13, wherein receiving the configuration information includes receiving saved operational data of the fire control panel in the fire control system.

17. The method of claim 13, wherein the method includes periodically transmitting, by a fire control panel in the fire control system in the facility, the configuration information of the fire control system in the facility at a predetermined interval to the computing device.

* * * * *